United States Patent [19]

Mikami et al.

[11] Patent Number: 4,614,927

[45] Date of Patent: Sep. 30, 1986

[54] POLARIZED ELECTROMAGNETIC RELAY

[75] Inventors: Nobuo Mikami; Yuichi Kamo; Katsuto Kojima, all of Tokyo, Japan

[73] Assignee: NEC Corporation, Tokyo, Japan

[21] Appl. No.: 756,358

[22] Filed: Jul. 18, 1985

[30] Foreign Application Priority Data

Jul. 20, 1984 [JP] Japan ..... 59-150581
Jan. 21, 1985 [JP] Japan ..... 60-8614

[51] Int. Cl.[4] ..... H01F 7/08

[52] U.S. Cl. ..... 335/78; 335/80; 335/279

[58] Field of Search ..... 335/78, 79, 80, 229, 335/230, 234, 279

[56] References Cited

U.S. PATENT DOCUMENTS 4,538,126 8/1985 Bando ..... 335/78
4,560,966 12/1985 Nagamoto et al. ..... 335/80
4,563,663 1/1986 Niekawa et al. ..... 335/78

OTHER PUBLICATIONS

Design of a Relay with a Movable Permanent Magnetic, by Ozawa et al., 32nd National Relay Conference, Apr. 17–18, 1984, pp. 4–1 to 4–9.

*Primary Examiner*—George Harris
*Attorney, Agent, or Firm*—Laff, Whitesel, Conte & Saret

[57] ABSTRACT

A polarized electromagnetic relay has a movable block which includes two U-shaped magnetic plates, each of which has first and second ends. The plates are fixed on individually associated and opposite poles of a permanent magnet to oppose each other. A core has one end placed between the two magnetic plates. A yoke is magnetically connected to the core, the yoke having a fork on one end thereof. The fork is placed outside each of the two magnetic plates. A spool with a coil mounted thereon has a center hole through which the core is inserted. The movable block is supported in a manner which enables it to move in a direction which is parallel to the magnetic axis of the permanent magnet.

13 Claims, 37 Drawing Figures

POLARIZED ELECTROMAGNETIC RELAY

BACKGROUND OF THE INVENTION

Field of the Invention

This invention relates to a polarized electromagnetic relay (hereunder referred to as a "PE relay") comprising an electromagnetic block and a movable block having a permanent magnet mounted thereon.

SUMMARY OF THE INVENTION

An object of this invention is, therefore, to provide a PE relay which is free from the disadvantages found in the prior art relay and which is capable of suppressing a fluctuation in magnetic reluctance and of performing excellent contact switching.

Another object of this invention is to provide a PE relay which can eliminate vibration on the card at actuating time, to prevent chattering.

A further object of this invention is to provide a PE relay capable of providing a larger space for the actuating part so as to transmit the magnetic force on the movable block of the relay effectively to the contact spring by the use of a card which is small in size and yet sufficiently strong in stuctural strength.

Still another object of this invention is to provide a PE relay which can be easily assembled.

A further object of this invention is to provide a PE relay which can easily be equipped with an early-make-before-break contact.

A still further object of this invention is to provide a PE relay capable of adjusting the movable contact spring independently so as to easily adapt the total spring load characteristic to the magnetic attraction force characteristic and of providing an optimal contact and contact releasing force between the contacts.

Still another object of this invention is to provice a PE relay which has a sufficiently large dielectric strength between contacts.

BRIEF DESCRIPTION OF THE DRAWINGS

The above-mentioned objects and features of this invention can be more clearly understood from the following detailed description and the attached drawings.

In the drawings, the same reference numerals denote the same structural elements.

DESCRIPTION OF THE PRIOR ART

An example of such a PE relay was published in an article entitled "Design of a Relay with a Movable Permanent Magnet" and presented by K. Ozawa et al. at the 32nd Annual National Relay Conference held on Apr. 17 and 18, 1984 at the Oklahoma State University, Stillwater, Okla.

Figure 1A:
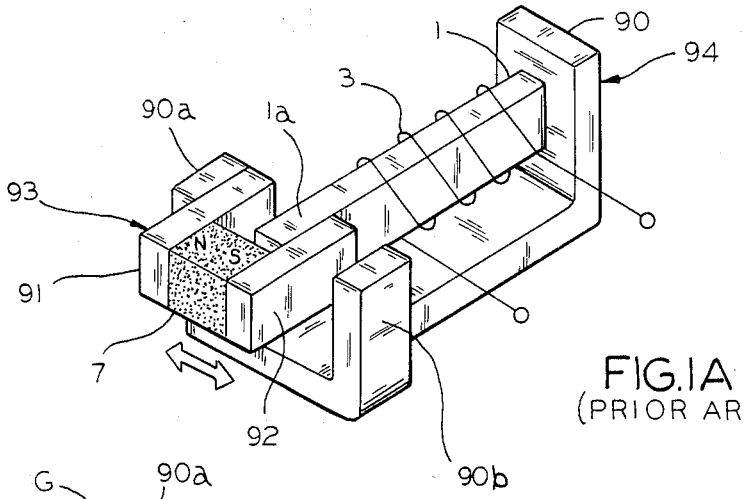
FIG.1A (PRIOR ART)
FIGS. 1A and 1B are perspective and plan views of a basic structure of a prior art PE relay.

Referring to FIG. 1A, a prior art PE relay has a movable block 93 including two magnetic plates 91, 92 and a permanent magnet 7, and an electromagnetic block 94 having a core 1 inserted in a coil 3, one end of which is placed between the magnetic plates 91, 92 and a yoke 90. The yoke 90 has one end magnetically connected to the other end of the core 1. The other end of yoke 90 is forked into two ends 90*a*, 90*b* and placed outside the magnetic plates 91 and 92. The magnetic plate 91 is positioned within a working gap defined by an end 1*a* of the core 1 and an end of 90*a* of the yoke 90, while the plate 92 is positioned within a working gap defined by the core end 1*a* and an end 90*b* of the yoke 90.

Figure 1B:
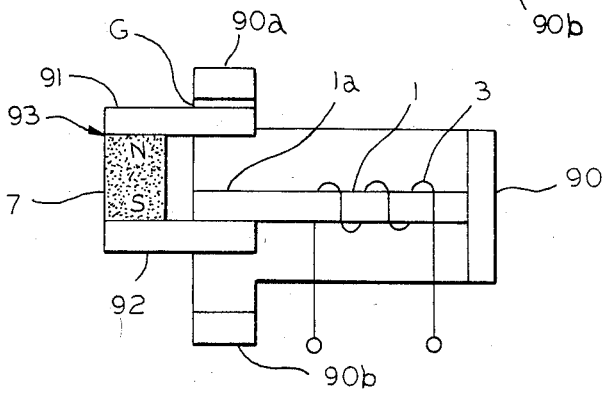
FIG.1B (PRIOR ART)

The movable block 93 is supported in a manner which is movable in a parallel translation, as shown by an arrow. The supporting mechanism for the movable block 93 may be constructed with a spool (not shown) wound around the coil 3 and having a guide on a flange thereof to carry the movable block 93 thereon, in a manner which is freely slidable in the lateral direction. According to such a prior art structure, if the dimensional precision in alignment between the core end 1*a* and the yoke ends 90*a* and 90*b* or between the magnetic plates 91 and 92 is not sufficient, an air gap G is often formed between the yoke end 90*a* and the magnetic plate 91 even if the core end 1*a* and the magnetic plate 92 are in contact as shown in FIG. 1B, thereby inconventiently causing fluctuations in the magnetic reluctnce, to make the contact switching operation unstable. Moreover, when the movable block 93 is attracted toward the side of the yoke end 90*a* and the magnetic plate 92 comes into contact with the core end 1*a*, the magnetic plate 91 vibrates due to the presence of the air gap G to cause a chattering at the time of contact switching. If an attempt is made to increase the dimensional precision, the yoke ends 90*a* and 90*b* must be bent at precisely the right angle, making the manufacturing process more difficult.

In the above-mentioned conventional structure, the core end 1*a* is positioned to oppose the yoke ends 90*a* and 90*b*, at the same height. In order to transmit the magnetic force acting on the magnetic plates 91 and 92 to a contact member (not shown) provided outside the electromagnetic block 94, a card (not shown) for supporting the movable block 93 must have an actuating part formed in a manner to avoid contact with the yoke ends 90*a* and 90*b*. As a result, it becomes impossible to effectively transmit the total forces acting across the movable block 93 to the contact member. Moreover, since the actuating part must be formed very thin to avoid making contact with the yoke ends 90*a* and 90*b*, a large structural strength cannot be expected. If the height or thickness of the card is increased to supplement structural strength in the actuating part, the whole structure becomes unavoidably bulky in size.

The conventional structure suffers still another defect. An early-make-before-break contact can not be formed to cause one movable contact to open only before another movable contact closes because the movable contacts are fixed on both sides of one movable contact spring to oppose stationary contacts, respectively. If only one movable contact spring is positioned between opposing stationary contacts, a portion of the displacement of the card is used in spring deflection after a contact is made. It becomes difficult to make the distance between contacts larger and hence, the dielectric strength between contacts larger.

DESCRIPTION OF THE PREFERRED EMBODIMENTS

Figure 2:
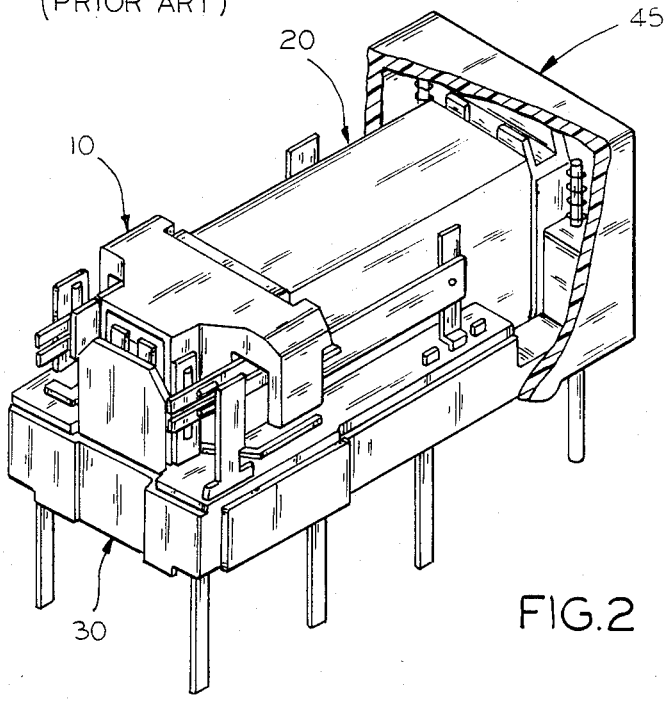
FIG. 2 is a perspective view of an embodiment according to this invention.

Referring to FIG. 2, an embodiment of this invention comprises a card block 10 including a permanent magnet. An electromagnetic block 20 includes a core and a yoke which are magnetized by an electric current passing through a coil. A base 30 fixetly mounts the electromagnetic block 20 and has contact members. A cover 45 is placed over the base 30.

Figure 3:
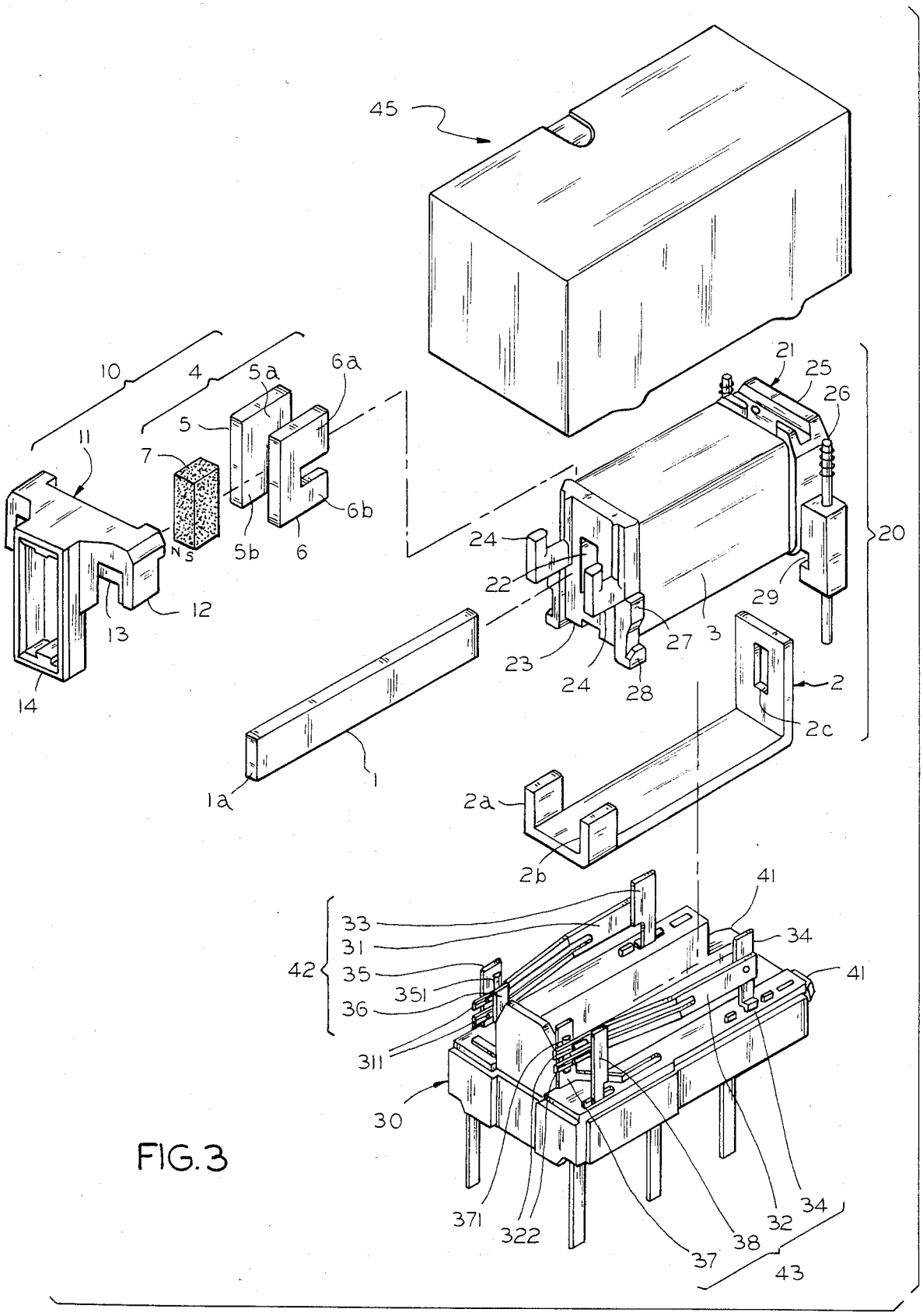
FIG. 3 is an exploded view of the embodiment shown in FIG. 2.

Referring to FIG. 3, the embodiment of FIG. 2 will now be described in more detail. This PE relay is of the bistable type. A movable block 4 is provided with a first U-shaped magnetic plate 5 having a first end 5*a* and a second end 5*b*, fixed on one magnetic pole (N pole) of a permanent magnet 7. A second U-shaped magnetic plate 6 has a first end 6*a* and a second end 6*b* fixed on the other pole (S pole) of the magnet 7. These magnetic plates 5 and 6 are made of a magnetic substance, such as Fe.

The card block 10 is used to support the movable block 4 on a supporting part 14 of a card 11. Actuating parts 12 are provided on both sides of the card 11 and are used for actuating contact springs 42 and 43. Guide lugs 13 are provided at locations which are further inside of the card 11 to slidably support the card block 10 in the direction extending toward magnetic poles (this will be described in more detail hereinafter).

A core 1 is made of a magnetic substance such as pure iron and is inserted into a hole 22 of a spool 21 to be fixedly engaged with a setting hole 2*c* of a yoke 2.

The yoke 2 is made of a magnetic substance, such as iron, and is in the shape of the letter "T" on one end, forked at two portions 2*a* and 2*b*. The portions 2*a* and 2*b* are bent at substantially right angles in order to oppose each other. The yoke 2 is bent like the letter L near the setting hole 2*c*.

The spool 21 has flanges 23 and 25 on both sides thereof and a coil 3 is wound therebetween. The flange 23 has guides 24 extending from both sides of the hole 2*c* in the shape of the letter L and projections 27 and 28 formed on both sides. The flange 25 has coil terminals 26 connected to the coil 3 on both ends thereof and grooves 29 formed thereunder. The core 1 and the yoke 2 are assembled in the spool 21 to complete the electromagnetic block 20.

The base 30 has two pairs of contact members 42 and 43 on its upper side. The contact members 42 and 43 include movable contact springs 31 and 32 which are rspectively fixed on one end of common terminals 33 and 34 and positioned on the other end respectively between inside stationary contact terminals 36 and 37 and outside stationary contact terminals 35 and 38. The free ends of contact springs 31 and 32 respectively have movable contcts 311, 312 (not shown), 321 (not shown) and 322 on both surfaces. The opposing surfaces of contact terminals 35, 36, 37 and 38 have stationary contacts 351, 361 (not shown), 371 and 381 (not shown). The material for the contact springs 31 and 32 may be Be-Cu and the material for the terminals 33, 34, 35, 36, 37 and 38 may be thin plate of non-magnetic substances such as Cu-Ni-Zn.

As will be explained hereinbelow, the base 30 has grooves (not shown) on its inside wall and projections 41 on its end portion. The spool 21 is fixed to the base 30 by engaging the projections 27, 28 and the grooves 29 of the spool 21 with the grooves (not shown) and the projections 41 of the base 30. The card block 10 is placed in a manner to hold the end of core 1*a* between the plates 5 and 6. Then the cover 45 is placed over the entire assembly to complete a polarized electromagnetic relay. The spool 21, the base 30 and the cover 45 are made of a synthetic resin such as polybuthylene terephthalate.

The operational principle of this invention will now be described referring to FIGS. 4, 5A and 5B. The structure basically comprises the electromagnetic block 20 having the core 1 inserted in the coil 3, and the yoke 2 magnetically connected to the core 1. The movable block 4 has two U-shaped magnetic plates 5 and 6 respectively fixed on opposite poles of the magnet 7. The forked portions 2*a* and 2*b* of the yoke 2 are bent at substantilly right angles, to oppose each other. The height of the portions 2*a* and 2*b* are lower than the position of the core end 1*a*.

The movable block 4 is placed so that the core end 1*a* is positioned between the plate ends 5*a* and 6*a*. The portions 2*a* and 2*b* are opposed to the outsides of these plate ends 5*b* and 6*b* respectively. An N pole is generated on the plate ends 5*a* and 5*b* and an S pole is generated on the plate ends 6*a* and 6*b* by the magnetic flux of the magnet 7. A magnetic field is generated between the plate ends 5*a* and 6*a* and between the plate ends 5*b* and 6*b*. A magnetic pole is generated on the core end 1*a* by the electric current fed through the coil 3, while the opposite magnetic pole is generated on the portions 2*a* and 2b. By the attraction or the repulsion force which acts between the stationary magnetic pole by the magnet 7 and the variable magnetic pole energized by the coil 3, the movable block 4 moves in a tanslation which is approximately parallel to the magnetic axis of the magnet and in the directions marked with a doubled ended arrow in the figure. The total spring load caused by contact members outside the movable block 4 is assumed to be symmetrical relative to the center of the displacement of the movable block 4.

Figure 5A:
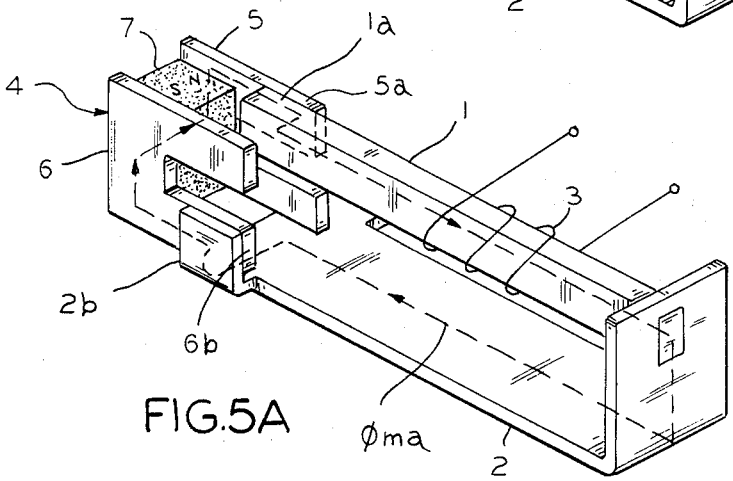
FIGS. 5A and 5B are explanatory views showing the structure of FIG. 4 in operation.

Referring to FIG. 5A, the movable block 4 is attracted to the side of the portion 2b. As a result, the plate end 6b contacts the portion 2b, while the plate end 5a contacts the core end 1a. In this case, the magnetic flux $\phi_{ma}$ forms a closed magnetic circuit in the path, i.e., the N pole of the magnet 7, the plate end 5a, the core end 1a, the core 1, the yoke 2, the portion 2b, the plate end 6b and the S pole of the magnet 7.

When electric current I (FIG. 5B) is passed through the coil 3 to energize the core end 1a as an N pole, the portions 2a and 2b become S poles, affecting a repulsive force between the core end 1a and the plate end 5a, and affecting an attractive force between the core end 1a and the plate end 6a, as well as an attractive force between the portion 2a and the plate end 5b and a repulsive force between the portion 2b and the plate end 6b. The total resultant of the attraction and repulsion forces displace the movable block 4 in approximately a translation which is parallel to the magnetic axis toward the side of the portion 2a where it is retained, as indicated in FIG. 5B. The magnetic flux $\phi_{mb}$ forms a closed magnetic circuit in the path, i.e., the N pole of the magnet 7, the plate end 5b, the portion 2a, the yoke 2, the core 1, the core end 1a, the plate end 6a, and the S pole of the magnet 7. Even after the electrical current supply is cut off, the movable block 4 holds the condition by itself due to the magnetic flux of the magnet 7.

Figure 6:
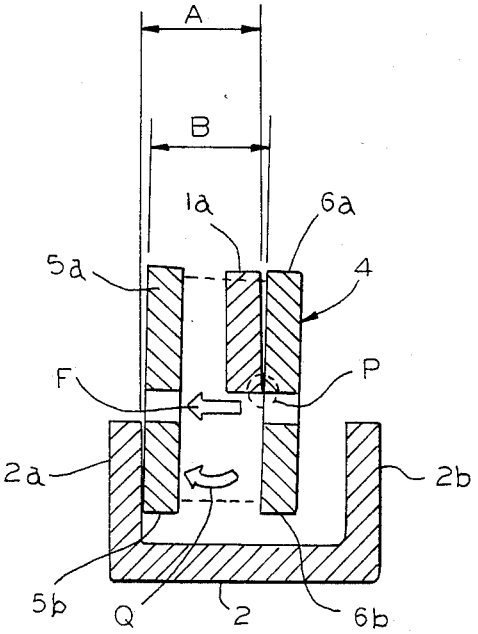
FIG. 6 is a cross sectional view of the first modification to the embodiment structure shown in FIG. 4.

FIG. 6 shows a magnetic structure wherein the distance A between the right face of the core end 1a and the inner face of the portion 2a does not coincide with the distance B between the inner face of the plate 6 and the outer face of the plate 5 (A>B) due to an insufficient precision during the bending of the portions 2a and 2b. In such a structure, even if the block 4 is displaced by the magnetic force F to make the plate end 6a come to contact with the core end 1a, the plate end 5b and the portion 2a cannot contact each other to have a gap therebetween. However, the attractive force acting between the portion 2a and the plate end 5b and the repulsive force acting between the portion 2b and the plate end 6b cause a rotational force Q to act on the movable block 4 and to make the same rotate clockwise around a fulcrum P within the scope of support by a guide (not shown). This causes the plate end 5b to come into contact with the portion 2a.

As described above, it is possible to cause the plate ends 5a, 5b, 6a and 6b to make contact with the core end 1a. The portions 2a and 2b in this embodiment achieve stable contact switching with little fluctuation in magnetic reluctance, even in case of faulty dimensional precision during the bending of the yoke 23 or the assembly of the electromagnetic block. Since the contact of the plates 5 and 6 is secured, the movable block 4 does not suffer from vibration. Hence, chattering at contact switching can be prevented. Since the portions 2a and 2b tend to spring back after they are bent to a right angle, the assembly of the components becomes difficult. However, the above-mentioned basic inventive structure allows an easy assembly of electromagnetic blocks to enhance the productivity in polarized electromagnetic relay manufacture.

Figure 7A:
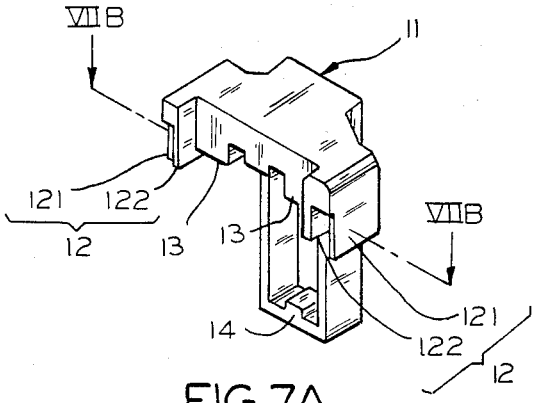
FIG. 7A is a perspective view of part of the structure shown in FIG. 3.
Figure 7B:
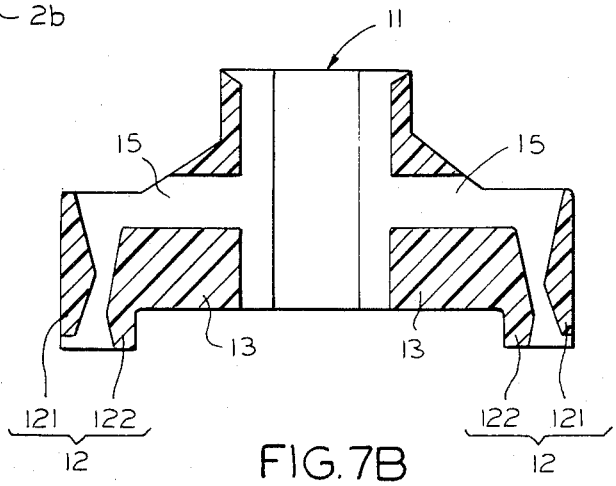
FIG. 7B is a cross sectional view of FIG. 7A taken along the line VIIB—VIIB.

A description will now be made for the card 11 shown in FIG. 3, with reference made to FIGS. 7A and 7B. The card 11 may be made of a resin such as polyphenylene sulfide. The actuating parts 12 have outside studs 121 and inside studs 122. The contact springs 31 and 32 (FIG. 3), on the base 30, are respectively placed between the two studs. The substantially parallel translation of the card block 10 causes the studs 121 and 122 (FIG. 7) to energize the contact springs 31 and 32. The guide lugs 13 are carried by and supported on the L-shaped guides 24 (FIG. 3). The upper ends of the guides 24 move relatively within a slide groove 15 of the card 11. As has been described above, as compared with the position of the core end 1a, the height of the portions 2a, 2b is lower, so that an empty space exists above the portions 2a, 2b. The card 11 shown in the Figures utilizes the empty space effectively to linearly transmit the magnetic force which acts on the plates 5, 6. This invention enables sufficient structural strength without increasing the height of the card 11 to produce a PE relay which is small and yet effective.

A description will now be given below of a magnetic structure of a bistable-type PE relay which includes residual plates which form a magnetic gap between the core end 1a and the plates 5 and 6.

Figure 4:
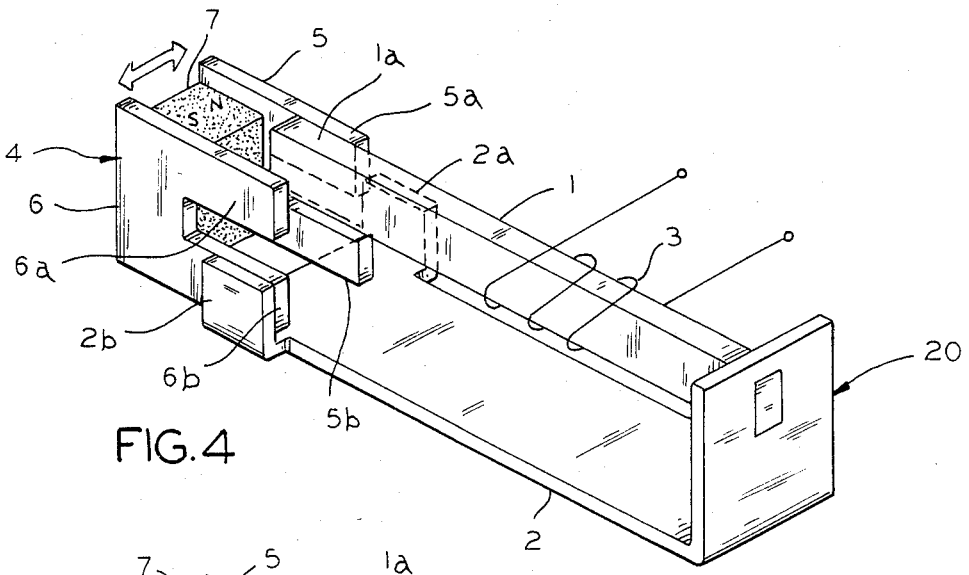
FIG. 4 is a partial structural view of the embodiment shown in FIG. 2.
Figure 5B:
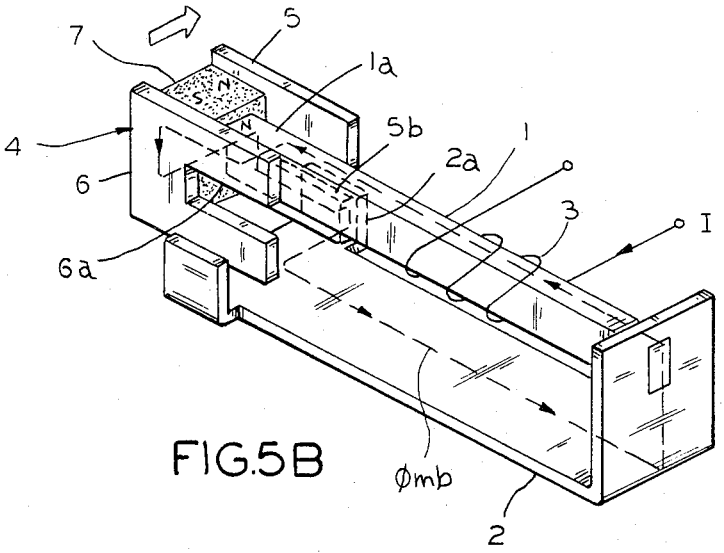
Figure 8A:
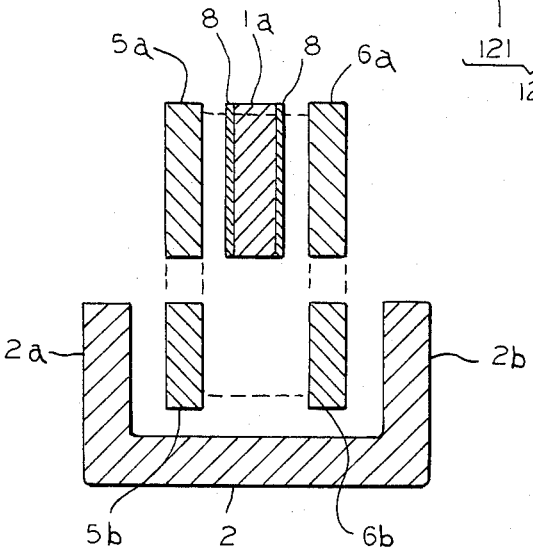
FIGS. 8A and 8B are cross sectional views of the second and the third modifications to the magnetic structure in FIG. 4.
Figure 8B:
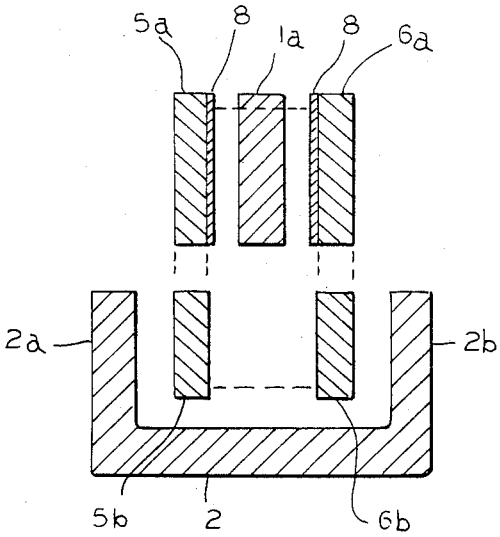
Figure 9A:
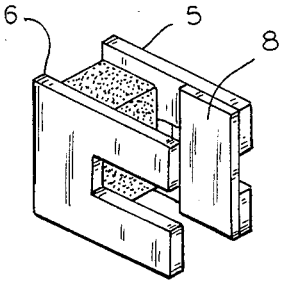
FIGS. 9A and 9B are views of the first modifications to the structures shown in FIGS. 8A and 8B respectively.
Figure 9B:
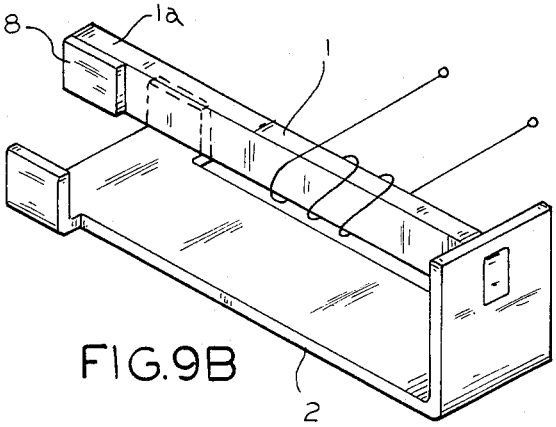
Figure 10B:
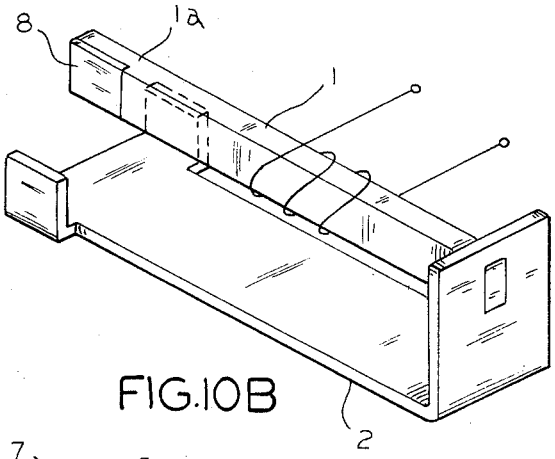
FIGS. 10A and 10B are views of the second modifications to the structures shown in FIGS. 8A and 8B respectively.
Figure 10A:
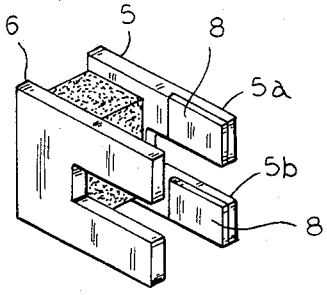

FIG. 8A shows the second modification of the magnetic structure shown in FIG. 4. Two residual plates 8 of identical thickness of non-magnetic material, such as Ni-Cu, are mounted on both sides of the core end 1a. The residual plates 8 are provided for breaking the contact between the core end 1a and the plate end 5a or 6a, without difficulty, when the movable block 4 is displaced. FIG. 8B shows the third modification of the magnetic structure shown in FIG. 4, wherein residual plates of identical thickness are mounted on inner surfaces of the plate ends 5a and 6a.

FIGS. 9A, 9B, 10A, and 10B show how to mount the residual plates of FIGS. 8A and 8B. In the structures shown in FIGS. 9A and 9B, the residual plates 8 are attached to the surfaces of the magnetic plate 5 and the core end 1a. It is, therefore, necessary to determine the dimension of respective components and the displacement distance of the movable block 4 by taking into account the thickness of the residual plates 8. In the structures shown in FIGS. 10A and 10B, space equivalent to the thickness of the residual plats 8 is reserved in advance at the mounting positions of the core end 1a and the plate ends 5a and 5b. The residual plates 8 are mounted respectively on the plate ends 5a and 5b. In this structure, it is not necessary to take into account the displacement of the movable block 4. The thickness of the plates 8 determines the dimension of each component.

Figure 11:
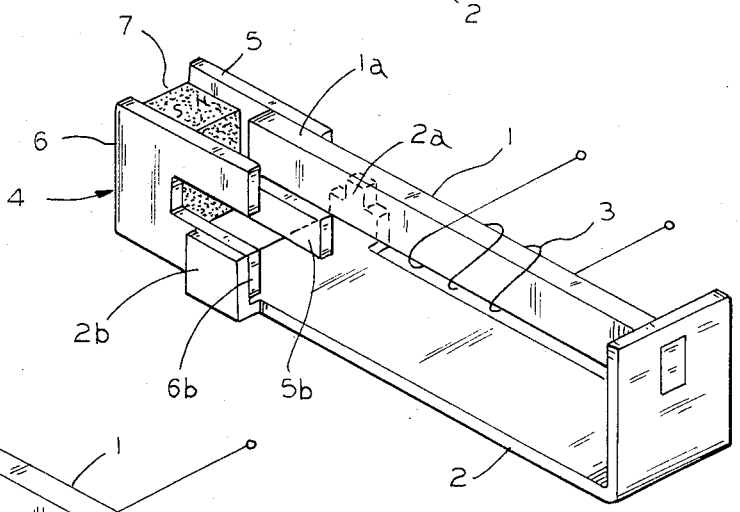
FIG. 11 is a view of the fourth modification to the structure shown in FIG. 4.

A magnetic structure of a monostable-type PE relay, according to this invention, will be described below. FIG. 11 shows a modified magnetic structure of FIG. 4 wherein the size of the portion 2a is different from that of the portions 2b. The opposing area of the plate end 5b and the portion 2a are smaller than the opposing area of the magnetic plate end 6b and the portion 2b. This makes the magnetic reluctance on the side of the portion 2a larger and disturbs the reluctance balance.

It is, therefore, possible to achieve a monostable PE relay according to this invention. The structure is such that the movable block 4 is attracted toward the side of the portion 2b by the force combined with the spring load, when coil 3 is not energized. When electrical current is supplied to the coil 3 to make the core end 1a an N pole, the movable block 4 is attracted toward the side of the portion 2a to thereby actuate the contact members (not shown) for electrical switching.

Figure 12:
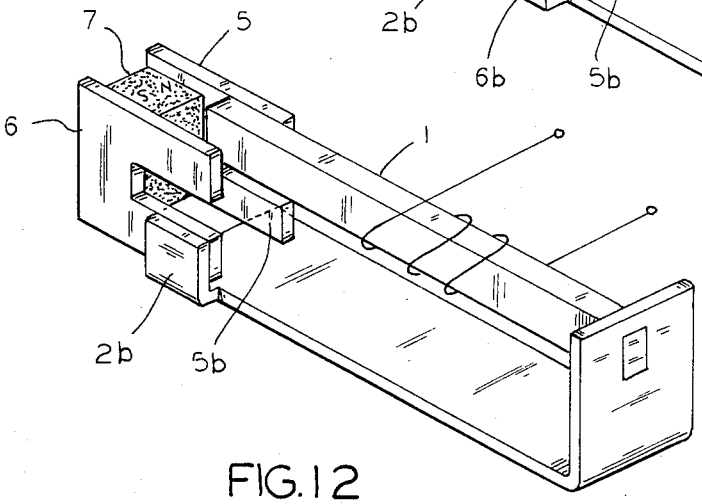
FIG. 12 is a view of the fifth modification to the structure shown in FIG. 4.

FIG. 12 shows another modification of the magnetic structure shown in FIG. 4 wherein the portion 2a opposing the magnetic plate end 5b is removed to disturb the balance in magnetic reluctance. A stopper (not shown) for abutting the plate end 5b may be mounted on the base 30 or the cover 45 of FIG. 3.

Figure 13A:
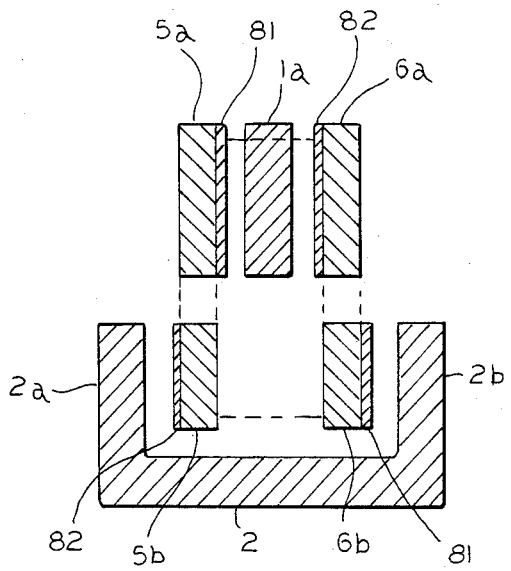
FIGS. 13A and 13B are cross sectional views for describing the sixth and the seventh modifications to the structure shown in FIG. 4.

Other magnetic structures of a monostable type PE relay having residual plates will be explained. FIG. 13A shows a modification of the magnetic structure shown in FIG. 4 as having thick residual plates 81 mounted on the inner surface of the plate end 5a and the outer surface of the plate end 6b. Thin residual plates 82 are mounted on the inner surface of the plate end 6a and on the outer surface of the plate end 5b.

Figure 13C:
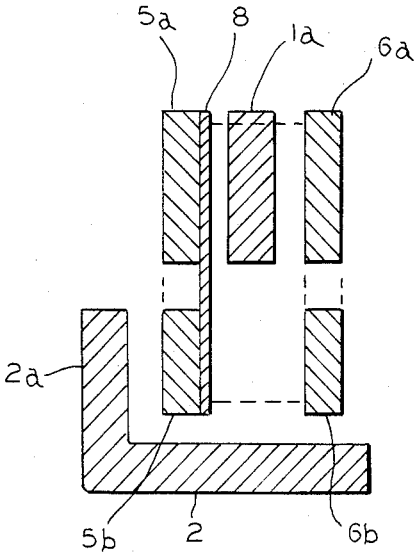
FIGS. 13C and 13D are cross sectional views for illustrating the first and the second modifications to the structure shown in FIG. 12.
Figure 13B:
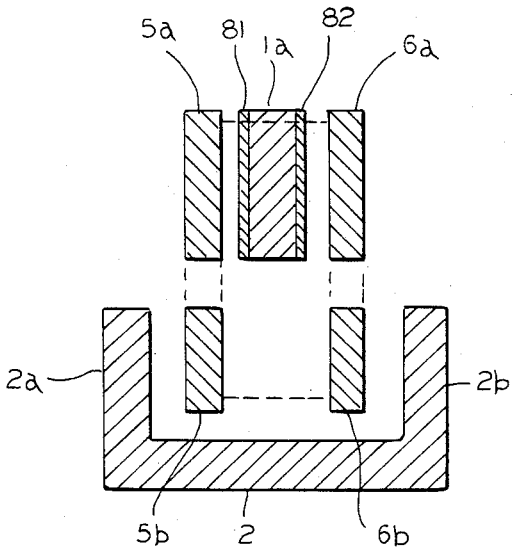

FIG. 13B shows a modification to the magnetic structure shown in FIG. 4 having a thick residual plate 81 mounted on the side of the portion 2a of the core end 1a, and a thin residual plate 82 mounted on the side of the portion 2b of the core end 1a.

FIG. 13C shows a modification of the magnetic structure shown in FIG. 12 wherein the portion 2b is omitted, while the residual plate 8 is mounted on the inner surface of the plate ends 5a and 5b.

Figure 13D:
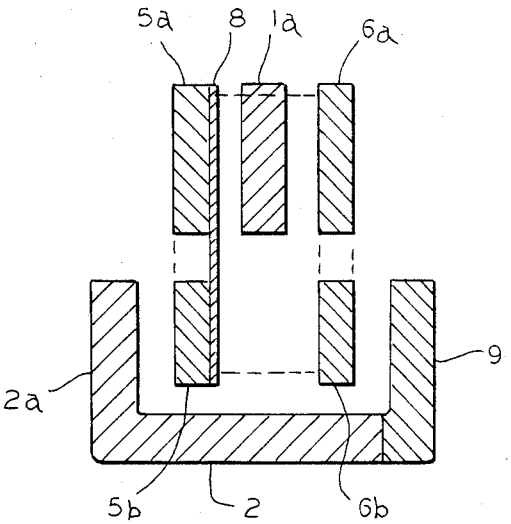
Figure 14A:
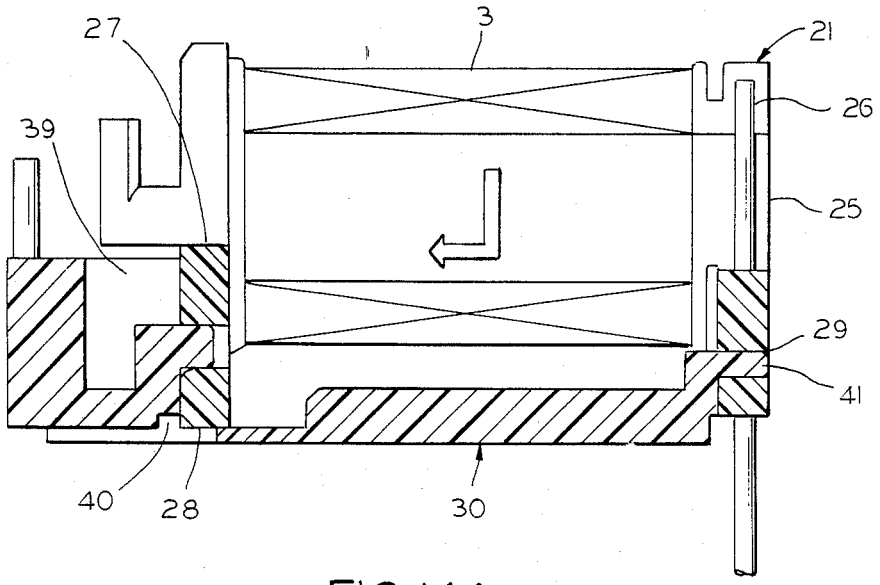
FIGS. 14A through 14C are views which show a partial assembly of components of the structure shown in FIG. 3.
Figure 14B:
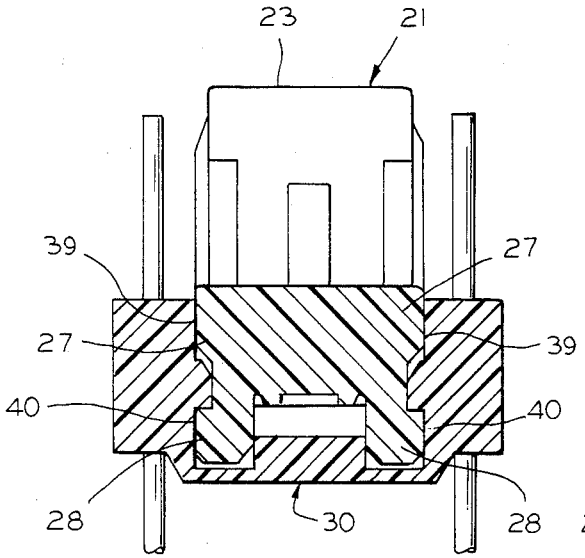
Figure 14C:
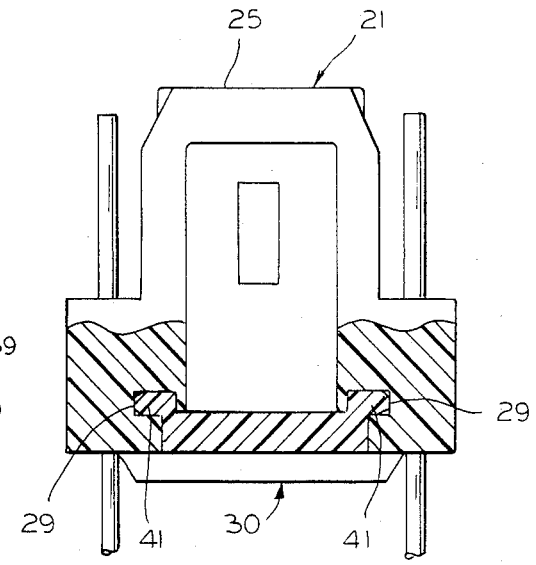

FIG. 13D shows another modification of the magnetic structure shown in FIG. 12 having a non-magnetic material such as a non-magnetic alloy, press mounted as a stopper 9 to replace the magnetic portion 2b.

In any one of the structures shown in FIGS. 13A through 13D, the balance in magnetic reluctance has been, therefore, disturbed. The movable block is attracted toward the side of portion 2a due to the synthetic force combined with the spring load applied on the contact members. In FIGS. 13A and 13B, the difference in the thickness between non-magnetic residual plates disturbs the balance in magnetic reluctance.

Referring now to FIGS. 14A through 14C and FIG. 3, an explanation will be given of the assembly structure of the spool 21 and the base 30. Grooves 39 and 40 are respectively provided on both sides of the inner wall faces of the base 30. The projections 41 are provided on one of the ends of the base 30. The spool 21 has already been described above. When the spool 21 is placed, from above, over the base 30 and moved in the directions indicated by an arrow, the projections 27 and 28 engage the grooves 39 and 40. Further, the projections 41 are attached to one end of the base 30 in a manner which enlarges from the center outward and is engaged with the grooves 29 of the spool 21. In this manner, the spool 21 can be simply but firmly assembled in the base 30 to prevent any shaking at the time when contact is made during switching. This eliminates the need for affixing members such as screws or adhesives. The assembly process of the electromagnetic relays can be simplified to reduce the costs.

Figure 15:
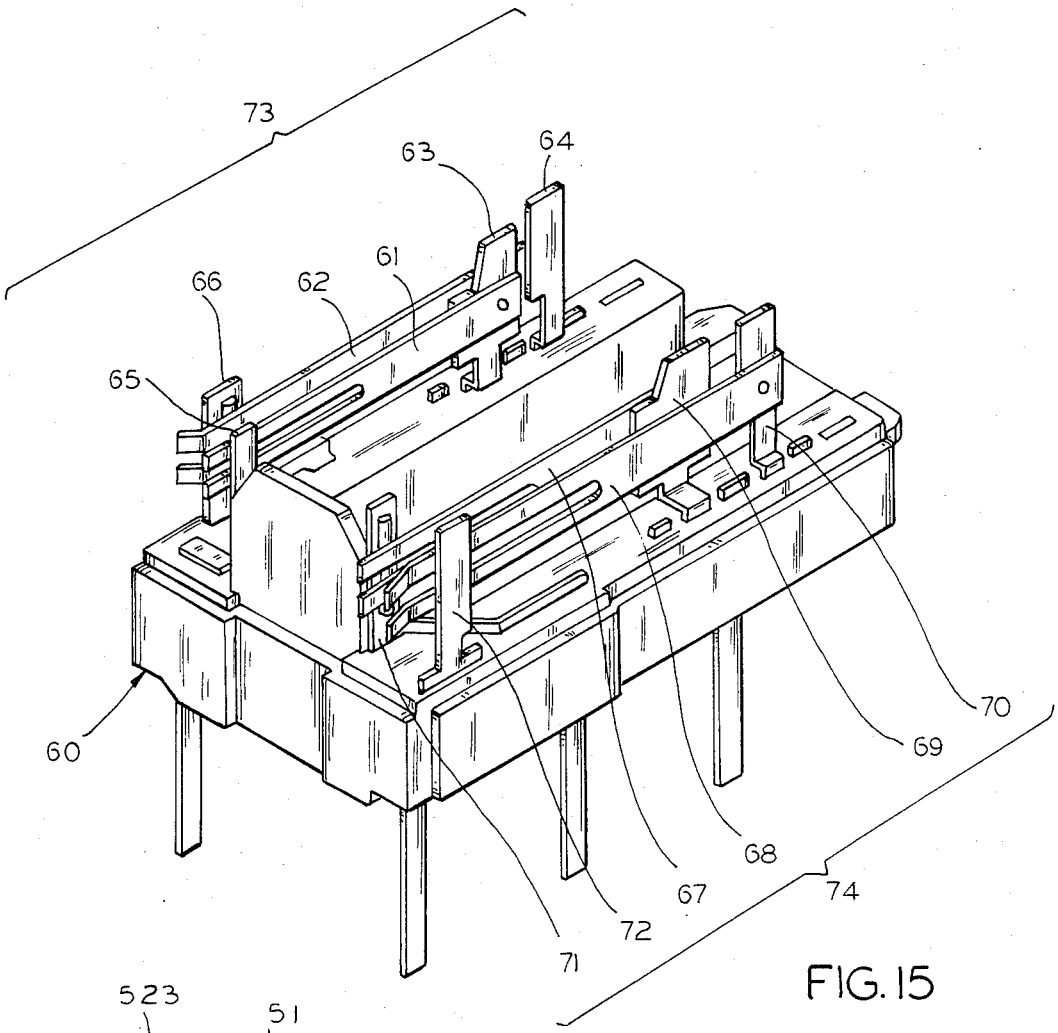
FIG. 15 is a view for illustrating a modification to a part of the structure shown in FIG. 3.

Referring to FIG. 15, a modification of the base shown in FIG. 3 will be described below. In this embodiment, two sets of contact members 73 and 74 are mounted on both sides of the upper portion of base 60. The contact member 73 includes two movable contact springs 61 and 62, while the contact member 74 includes two movable contact springs 67 and 68. One end of each of the inner contact springs 61 and 67 is fixed onto one end of the common terminals 63 and 69. On the other end, contact springs oppose outside stationary contact terminals 66 and 72, respectively. The inside common terminal 63 and the outside common terminal 64 are connected together inside the base 60 and project from the bottom thereof. The same structure is applicable to that of the common terminals 69 and 70. The pressure applied on the contact springs 61, 62, 67 and 68 can be separately controlled by individually twisting the common terminals 63, 64, 69 and 70.

Figure 16A:
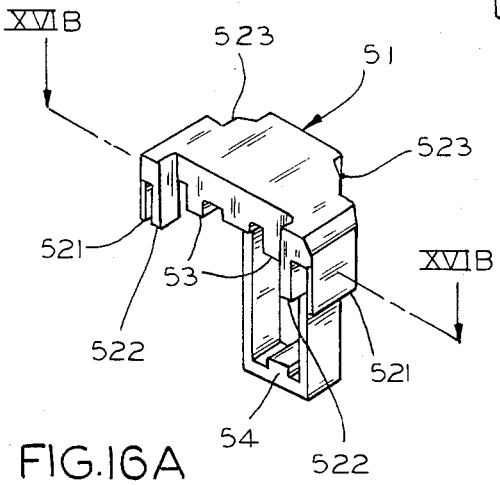
FIG. 16A is a view of a modification to the structure shown in FIG. 7A.
Figure 16B:
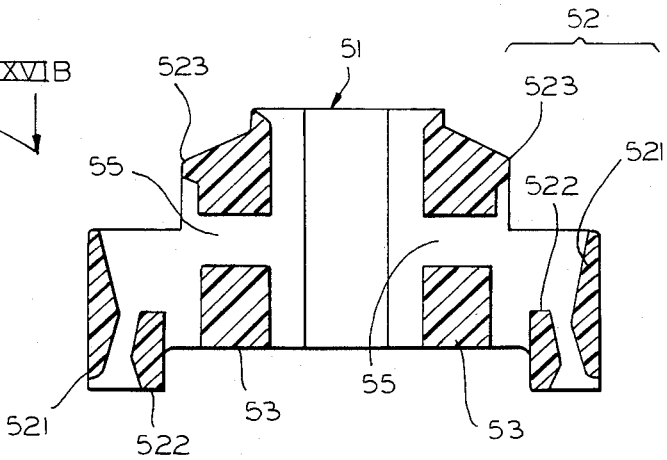
FIG. 16B is a cross sectional view of the structure shown in FIG. 16A along the line XVIB—XVIB.

An example of the card to actuate contact members mounted on the base 60 of FIG. 15 is shown in FIGS. 16A and 16B. The card 51 includes a supporting part 54 for supporting the movable block (not shown), actuating parts 52 for actuating contact members 73, 74 (refer to FIG. 15) and guide lugs 53. The operation of the supporting part 54 and the guide lugs 53 is the same as the operation described for the card 30 shown in FIGS. 7A and 7B. The actuating part 52 comprises an outside stud 521, a center stud 522 and an inside stud 523. The contact springs 62 and 68 are respectively positioned between two studs 521 and 522 on both sides of the card 51. The contact springs 61 and 67 are placed between the studs 522 and 523 (refer to FIG. 15). The base 60 of FIG. 15 and the card 51 of FIGS. 16A and 16B form the structure of FIG. 3. It thus becomes possible to construct a polarized electromagnetic relay equipped with two sets of contact members 73 and 74 each having two movable contact springs 61, 62 and 67, 68.

Figure 17A:
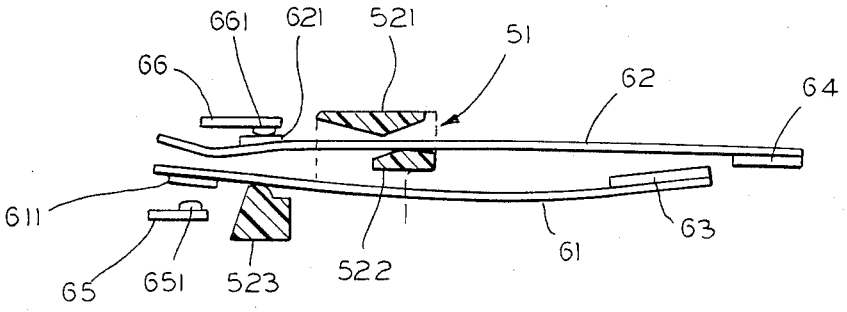
FIGS. 17A through 17C are views of the first modification to the contact structure shown in FIG. 15.
Figure 17B:
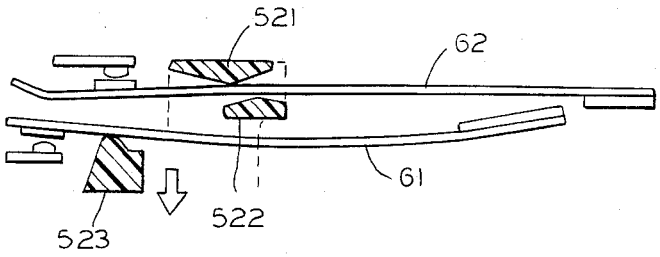
Figure 17C:
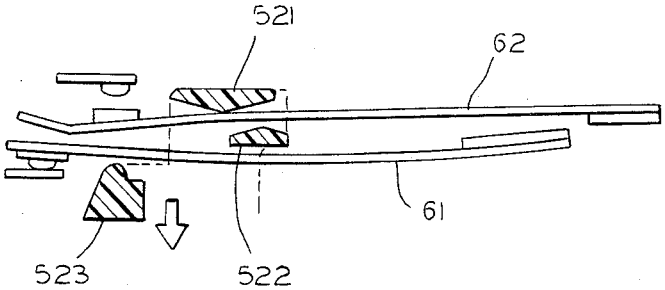

The first example of the structure of the contact members shown in FIG. 15 will be described next by referring to FIGS. 17A through 17C. The contact members 73 and 74 of the base 60 in FIG. 15 are actuated by the card 51 of FIGS. 16A and 16B. The contact terminals 65 and 66 (FIG. 17) have respectively stationary contacts 651 and 661. The contact springs 61 and 62 have movable contacts 611 and 621, which are respectively opposed to the contacts 651 and 661. The contact spring 61 is to be constantly pre-tensioned onto the contact terminal 65. The contact spring 62 is not energized by a pre-tensioned pressure. The stud 523 of the card 51 first presses the contact spring 61 to release the contact 611 from the contact 651. The stud 522 presses the contact spring 62 to cause the contact 621 to make contact with the contact 661 (FIG. 17A). Then, the magnetic force moves the card 51 in the direction marked with an arrow (FIG. 17B). The stud 522 releases the pressure on the contact spring 62, while the stud 521 presses the contact spring 62 to release the contact 621 from the contact 661 (FIG. 17B). When the card 51 moves further, the stud 523 releases the pressure on the contact spring 61, so that the contact 611 is brought into contact with the contact 651, because the contact spring 61 has been pre-tensioned to force it onto the contact terminal 65 (FIG. 17C). As described above, the early-break-before-make contact is constructed so that it closes one movable contact only after another movable contact is released.

Figure 18A:
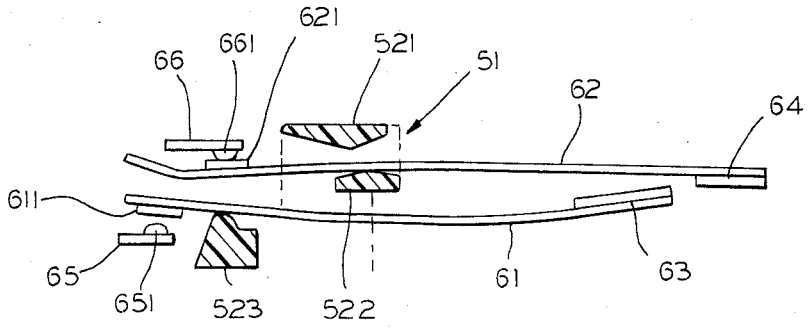
FIGS. 18A through 18C are views of the second modification to the contact structure shown in FIG. 15.
Figure 18B:
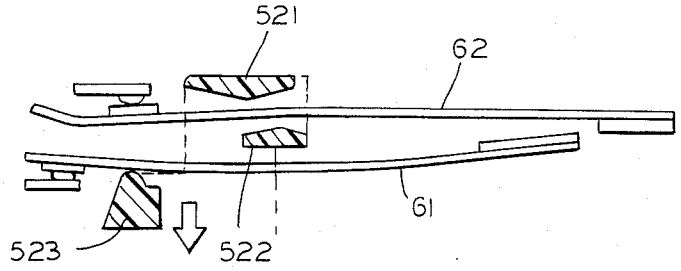
Figure 18C:
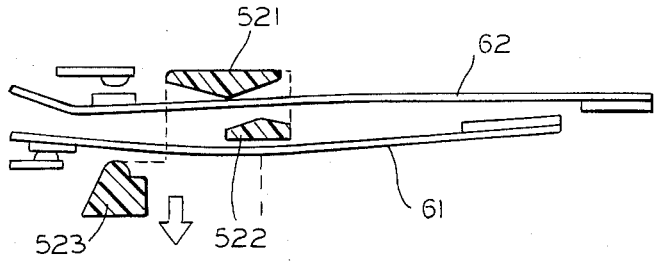

Referring to FIGS. 18A through 18C, the second example of the contact members of FIG. 15 is described. This is a modification of the contact structure shown in FIGS. 17A through 17C. In this embodiment, both of the contact springs 61 and 62 have a constantly applied pressure and are respectively pre-tensioned to force them onto the contact terminals 65 and 66. The distance between the stud 521 and the stud 523 is slightly larger, as compared to the distance shown in FIGS. 17A through 17C. The stud 523 first presses the contact spring 61 to release the contact 611 from the contact 651. The stud 522 presses the contact spring 62 to cause the contact 621 to make contact with the contact 661 (FIG. 18A). The magnetic force moves the card 51 in the direction marked with an arrow (FIG. 18B) so that the studs 523 and 522 respectively release the pressure on the contact springs 61 and 62. Then, due to the pressure constantly being applied on the contact springs 61 and 62, respectively, the contacts 611 and 651 come into contact with each other and simultaneously the contact 621 keeps on making contact with the contact 661 (FIG. 18B). When the card 51 moves further, the stud 521 presses the contact spring 62 to release the contact 621 from the contact 661 (FIG. 18C). As described above, an early-make-before-break contact opens one movable contact only after another movable contact is closed.

Figure 19A:
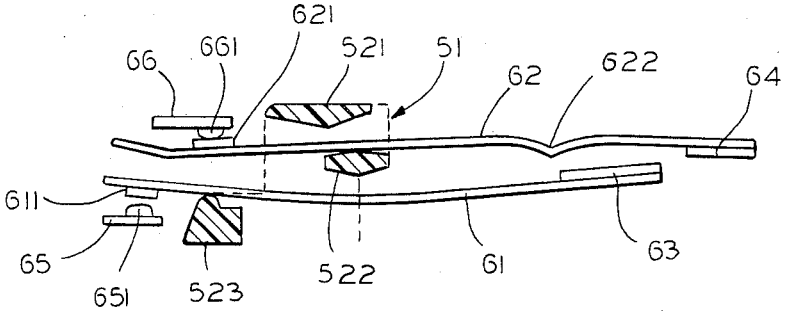
FIGS. 19A through 19B are views of a modification to the contact structures shown in FIGS. 18A through 18C.
Figure 19B:
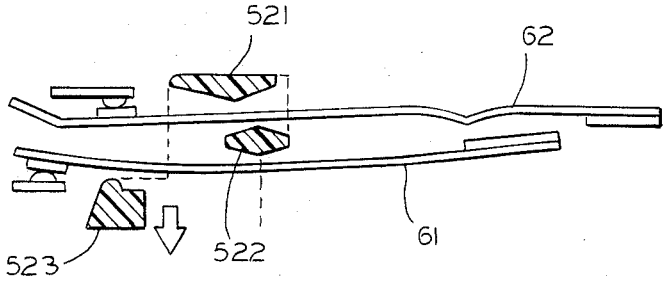
Figure 19C:
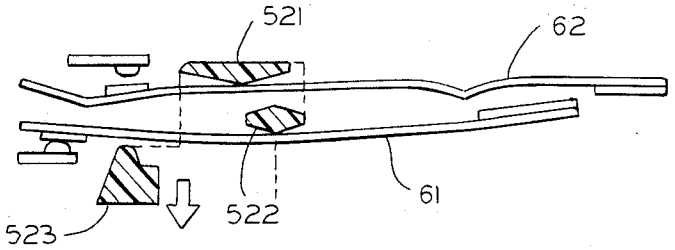

FIGS. 19A through 19C show another example of such structures. This example differs from the one shown in FIGS. 18A through 18C in that the stud 522 also presses the contact spring 61 and in that the contact spring 62 includes a bent portion 622 at an intermediate location.

Although the above description of contact members is directed to the contact springs 61 and 62 alone, the same description can also be applied to the contact springs 67 and 68 which are provided on the opposite side of the electromagnetic block. The pressure applied constantly onto the movable contact springs 61, 62, 67 and 68 can be separately controlled by twisting the common terminals 63, 64, 69 and 70 which are independently fixed on the movable contact springs. In the example of the contacts shown in FIGS. 19A through 19C, the pressure is applied onto the contact spring 62 by bending it at the bent portion 622.

As described in the foregoing specification, an early-break-before-make contact and an early-make-before-break contact can be simply constructed by varying the configuration or relative positions of studs of the card or controlling the pressure which is constantly applied on movable contact springs. Since two movable contact springs can be adjusted separately, the total spring load characteristic can be adjusted to suit the magnetic characteristic and to provide an optimal contact and contact-releasing force and an excellent reliability in contact. Since one movable contact spring has one movable contact to oppose a stationary contact, the displacement of the card can be fully utilized without waste to bend the contact spring. The distance between contacts can be enlarged to thereby increase dielectric strength between contacts.

In the above embodiments, the materials for the respective components are not limited to those described, but may be any material so far as they meet conditions of the components.

Those who are skilled in the art will readily perceive how to modify the invention. Therefore, the appended claims are to be construed to cover all equivalent structures which fall within the true scope and spirit of the invention.

What is claimed is:

1. A polarized electromagnetic relay comprising:

a movable block including first and second U-shaped magnetic plates, each of which has first and second ends, said plates being fixed on individually associated and opposite poles of a permanent magnet to set said first and second ends of said first magnetic plate opposite said first and second ends of said second magnetic plate, respectively;

an electromagnetic block including a core having one end thereof placed between said first end of said first magnetic plate and said first end of said second magnetic plate of said movable block;

a yoke magnetically connected to said core, said yoke having a fork on one end thereof, the ends of said fork being placed outside each of said second ends of said first and second magnetic plates in said movable blocks;

a spool having a center hole through which said core extends, a guide for supporting said movable block in a manner to enable it to move in a direction which is parallel to the magnetic axis of said permanent magnet, and a coil wound around said spool;

a base for fixing said electromagnetic block, said base having at least one set of contact members mounted thereon; and a card for supporting said movable block and actuating said contact members responsive to the translation of said movable block parallel to the magnetic axis of the permanent magnet.

2. The polarized electromagnetic relay as claimed in claim 1 further comprising:

a residual plate made of non-magnetic material placed within at least on of two gaps defined by said core end and said first ends of said first and second magnetic plates in said movable block.

3. The polarized electromagnetic relay as claimed in claim 1 further comprising:

two residual plates having different thicknesses and being made of non-magnetic material, said plates being placed with individually associated ones of two gaps defined by said forked core end and said first ends of said first and second magnetic plates in said movable block, respectively.

4. The polarized electromagnetic relay as claimed in claim 3 further including:

two residual plates having different thicknesses placed within individually associated one of two gaps defined by said forked ends of said yoke and said second ends of said first and second magnetic plates in said movable block, respectively.

5. The polarized electromagnetic relay as claimed in claim 1 wherein the opposed areas of one of said forked ends of said yoke and of said one magnetic plate are different from the opposed areas of another forked end of said yoke and another magnetic plate.

6. The polarized electromagnetic relay as claimed in claim 1 wherein said each of contact members has two movable contact springs fixed on one end to a common terminal, and the other end of said movable contact spring having stationary contact terminals.

7. The polarized electromagnetic relay as claimed in claim 6 wherein said card has an actuating part comprising a set of three actuating studs which are respectively placed on opposite sides and at the center of said two movable contact springs.

8. The polarized electromagnetic relay as claimed in claim 6 wherein the upper end of said common terminal is forked to form two terminals, one of said two terminals being fixed to said one movable contact spring and the other of said two terminals being fixed to another movable contact spring.

9. A polarized electromagnetic relay comprising:

a movable block including first and second generally U-shaped magnetic plates, each of which has first and second ends, said plates being fixed on opposite poles of a permanent magnet with said first and second ends of said first magnetic plate opposite said first and second ends of said second magnetic plate, respectively;

an electromagnetic block including a core having one end thereof positioned between said first end of said first magnetic plate and said first end of said second magnetic plate of said movable block;

a yoke magnetically connected to said core and placed on one end thereof outside of one of said second ends of said first or second magnetic plates in said movable block;

a spool having a hole in which said core is positioned and a guide for supporting said movable block in a manner to move in the direction parallel to the magnetic axis of said permanent magnet, and a coil. wound around said spool;

a base having at least one set of contacts members and means for fixing said electromagnetic block; and a card for supporting said movable block and actuating said contact members with the parallel translation of said movable block.

10. The polarized electromagnetic relay as claimed in claim 9 further comprising:

a residual plate made of non-magnetic material placed within a gap defined by said core end and said first end of said magnetic plate opposed to said yoke end.

11. The polarized electromagnetic relay as claimed in claim 9 wherein each of said contact members has two movable contact springs fixed to a common terminal on one end of said springs, and said contact member being opposed to stationary contact terminals on the other end of said spring.

12. The polarized electromagnetic relay as claimed in claim 11 wherein said card has an actuating part comprising a set of three actuating studs which are respectively positioned on opposite sides and at the center of said two movable contact springs.

13. The polarized electromagnetic relay as claimed in claim 11 wherein the upper end of said common terminal is forked to form two terminals, one of said two terminals being fixed to said one movable contact spring and the other of said two terminals being fixed to another movable contact spring.

* * * * *